US007290656B1

(12) United States Patent
Crawford

(10) Patent No.: US 7,290,656 B1
(45) Date of Patent: Nov. 6, 2007

(54) SHEETROCK KNIFE AND HOLDER APPARATUS

(76) Inventor: Raymond Crawford, 214 W. Virtue St., Chalmette, LA (US) 70043

( * ) Notice: Subject to any disclaimer, the term of this patent is extended or adjusted under 35 U.S.C. 154(b) by 182 days.

(21) Appl. No.: 11/077,104

(22) Filed: Mar. 10, 2005

Related U.S. Application Data

(60) Provisional application No. 60/551,968, filed on Mar. 10, 2004.

(51) Int. Cl.

| | |
|---|---|
| ***A45C 11/26*** | (2006.01) |
| *B65D 85/28* | (2006.01) |
| *B65D 71/00* | (2006.01) |
| *B65D 81/02* | (2006.01) |
| *B26B 27/00* | (2006.01) |

(52) U.S. Cl. ..... 206/349; 206/372; 206/575; 30/298

(58) Field of Classification Search ..... 206/349, 206/372, 373, 576, 575, 582; 30/298, 329; 248/37.3; 224/904, 253

See application file for complete search history.

(56) References Cited

U.S. PATENT DOCUMENTS 3,390,810 A * 7/1968 Schnceweiss ..... 206/216
3,812,976 A * 5/1974 Rempel ..... 211/70.6
4,303,188 A * 12/1981 Calabrese ..... 224/674
4,416,372 A * 11/1983 Polk ..... 206/372
4,714,158 A * 12/1987 Oltman et al. ..... 206/349
4,947,998 A * 8/1990 Smeller ..... 211/70.6
5,005,710 A * 4/1991 Hofer ..... 211/70.6
5,092,463 A * 3/1992 Dees ..... 206/373
5,257,695 A * 11/1993 Henke et al. ..... 206/373
5,350,065 A * 9/1994 Darrey ..... 206/373
5,390,944 A * 2/1995 Sherwin ..... 280/47.35
5,398,809 A * 3/1995 Henke et al. ..... 206/373
5,492,346 A * 2/1996 Stadler et al. ..... 280/47.19

* cited by examiner

*Primary Examiner*—Alvin J. Grant
(74) *Attorney, Agent, or Firm*—Garvey, Smith, Nehrbass & North, L.L.C.; Charles C. Garvey, Jr.

(57) ABSTRACT

A gypsum panel knife and blade holder apparatus includes a blade holding pan having a bottom panel, side panels, end panels and an open top. The side panels each have an inside surface and an upper edge, the edges defining a pan periphery. The blade holder includes a plurality of slots that extend longitudinally on the blade holder, each slot being of a length that approaches the greater dimension of the length or width of the blade holder. A plurality of knives fit the blade holder at the slots, each of the knives having a blade with a width and a length, the width being much greater than the width for at least some of the knives.

19 Claims, 4 Drawing Sheets

SHEETROCK KNIFE AND HOLDER APPARATUS

CROSS-REFERENCE TO RELATED APPLICATIONS

Priority of U.S. Provisional Patent Application Ser. No. 60/551,968, filed Mar. 10, 2004, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to knives and holders that are used during the installation of sheetrock, the knives being of the type that have a very wide blade in relation to the length of the blade and holder therefor. More particularly, the present invention relates to an improved sheetrock knife, pan, and holder apparatus that provides a pan having an open top with a holder that removably affixes to the pan at the open top, the holder having spaced apart slots that are sized and shaped to receive the blade portion of the sheetrock knife and wherein a strap arrangement secures the blades to the holder in a storage position.

2. General Background of the Invention

In the construction of homes, building and the like, it is common to use a gypsum panel material (e.g. Sheetrock® brand) that is affixed to a framework of wooden or steel members known in the industry as "studs". The gypsum panels are first affixed to the framework. Tape and coatings are then applied to eliminate unsightly seams.

During such an installation of gypsum panels, the installers utilize knives that have very wide blades in relation to the length of the blade. These installers also employ pans for holding the liquid, slurry or semi-solid material that is applied to the gypsum panels in order to fabricate the completed wall.

The knife blades must be very wide in relation to the length of the knife blade because often a very large area is to be covered with a selected material, plaster, chemical or the like.

BRIEF SUMMARY OF THE INVENTION

The present invention provides an improved sheetrock knife and pan apparatus. A pan is provided that has a bottom panel, side panels and an open top. The side panels each have an inside surface and an upper edge, the edges defining in combination a periphery of the pan at the open top.

A knife blade supporting panel is removably or permanently attached to the pan at the open top, the panel having a peripheral edge that engages the pan side panels at the pan periphery.

The panel includes a plurality of slots that extend longitudinally across the panel, each slot being of a length that approaches the greater dimension of the length or width of the pan. For example, the knife blade supporting panel can be about four to five inches (4"-5") wide and about fourteen to fifteen inches (14"-15") long. The slots can be about twelve inches (12") long and spaced about one half to one inch (½"-1") apart.

A plurality of sheetrock installation knives are provided, each having a handle and a blade that is very wide in relation to its length. For example, the dimensions of a typical blade can be 4, 6, 8, 10 and 12 inches wide and about 4 inches long.

The pan bottom panel can have an area that is smaller than the area of the open top. Grooves in the bottom panel of the pan can be provided for receiving a blade edge, and for maintaining each stored blade in a vertical position.

The pan has a length and a width, the length being greater than the width and at least one of the slots has a length that approaches the length of the panel.

The panel provides a length and a width, the length being greater than the width and a plurality of slots having a length that approaches the length of the panel, the slots being generally parallel.

Each of the knives has a width that extends transversely at least one half the length or width of the pan and the knife is sized and shaped to fit one of the slots on the panel.

In the preferred embodiment, at least some of the side walls of the pan are inclined, and preferably all of the side walls of the pan are inclined.

The panel can optionally provide a tapered surface that preferably rests upon the pan at the periphery and upon one or more of the inclined pan side walls.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 6:
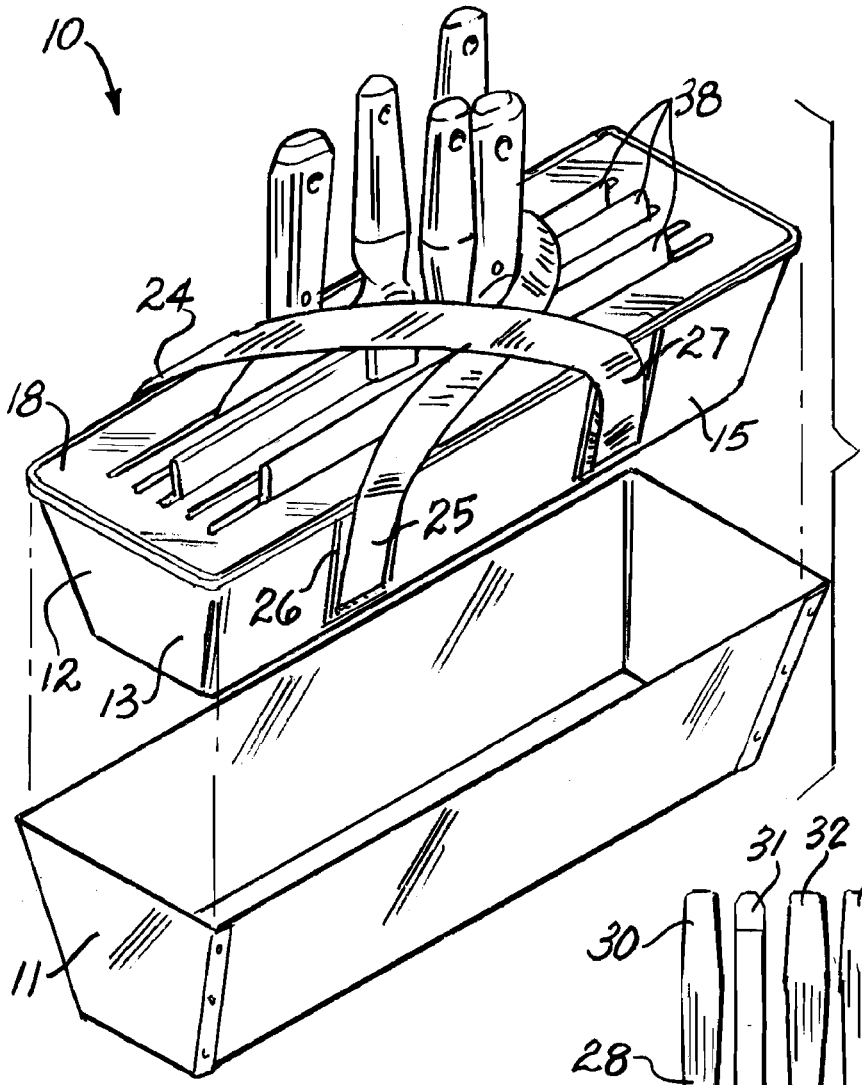
FIG. 6 is a perspective view of the preferred embodiment of the apparatus of the present invention.

In FIG. 6, the present invention provides an improved sheetrock knife and pan apparatus 10 that includes a pan 11 having a pan interior that is sized and shaped to receive and knife holder 12.

The pan 11 can be a commercially available pan that is used in gypsum panel installation, having a bottom, end walls, and side walls. The pan 11 can be made of any suitable structural material such as plastic, metal or the like. Pans of this type are commercially available, manufactured by Walboard Co. The pan 11 is used to contain a desired wall covering (e.g. plaster) to be applied using a selected knife or knives 31, 32, 33, 34.

Knife holder 12 has bottom 17, end walls 13, 14 and side walls 15, 16. The walls 13, 14, 15, 16 can be inclined as shown. Knife holder 12 has an interior 22. Top panel 18 fits the pan 11 periphery 19 that is positioned at the top of each wall 13, 14, 15, 16. Side walls 15, 16 can be preferably inclined and define an angle of about 5-30 degrees. Likewise, end walls 13-14 are preferably inclined, forming an angle of between about 5-30 degrees. In this fashion, the holder 12 can be nested in pan 11 for transport or storage.

Pan 11 can typically have dimensions of 4-24 inches wide by 2-12 inches high by 2-12 inches deep (as measured when pan 11 is sitting on a surface and can be filled with fluid, high refers to the floor-to-ceiling direction dimension). Pan 11 can have dimensions of 12-18 inches wide by 2-6 inches high by 2-6 inches deep. Pan 11 can have dimensions of, for example, 14⅜ inches wide by 3¾ inches high by 4⅝ inches deep.

Knife holder 12 preferably has dimensions to fit in pan 11, preferably by nesting in pan 11 as indicated in FIG. 6. Knife holder 12 is preferably made of high-impact polystyrene (HIPS) plastic, but could also be made of wood, foam (such as styrofoam), rubber, ABS plastic, PVC plastic, CPVC plastic, polybutylene plastic, or polyethylene plastic.

The panel 18 provides an upper surface 20, lower surface 21, and has a plurality of longitudinally extending generally parallel slots 23.

Figure 1:
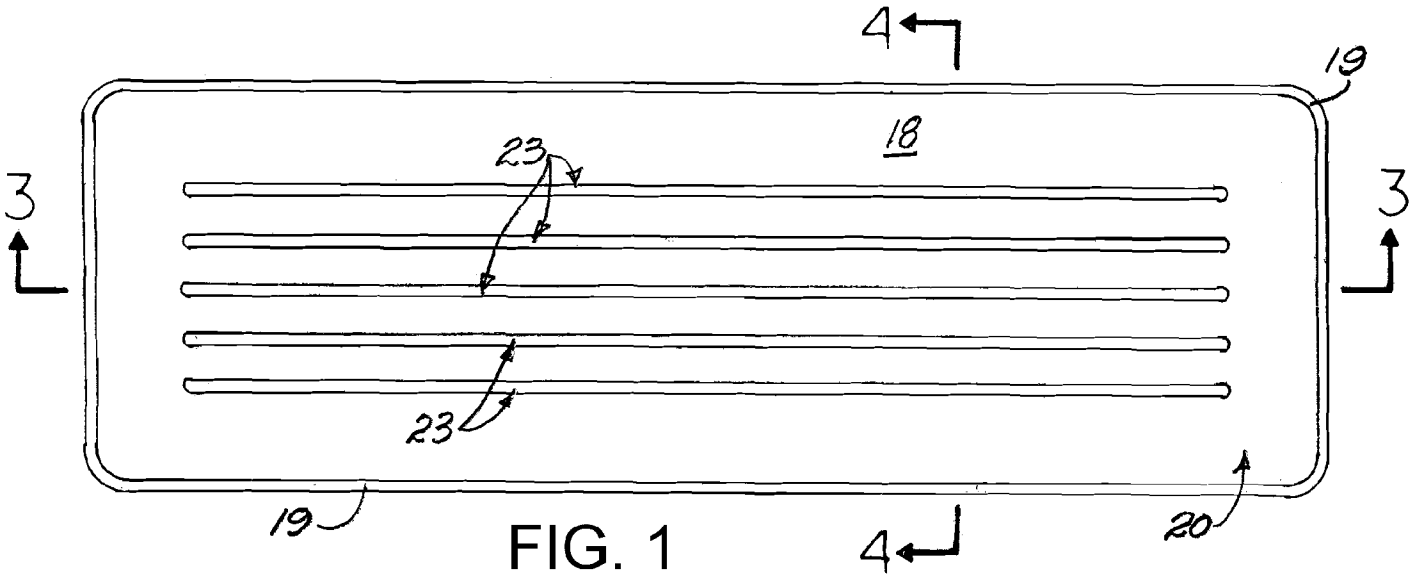
FIG. 1 is a plan view of the preferred embodiment of the apparatus of the present invention.
Figure 2:
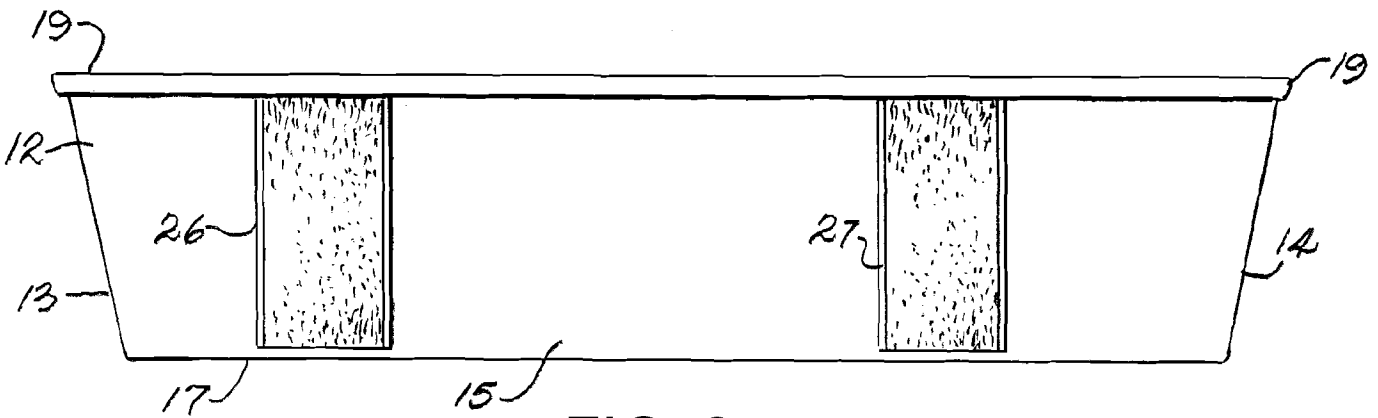
FIG. 2 is a frontal view of the preferred embodiment of the apparatus of the present invention.
Figure 3:
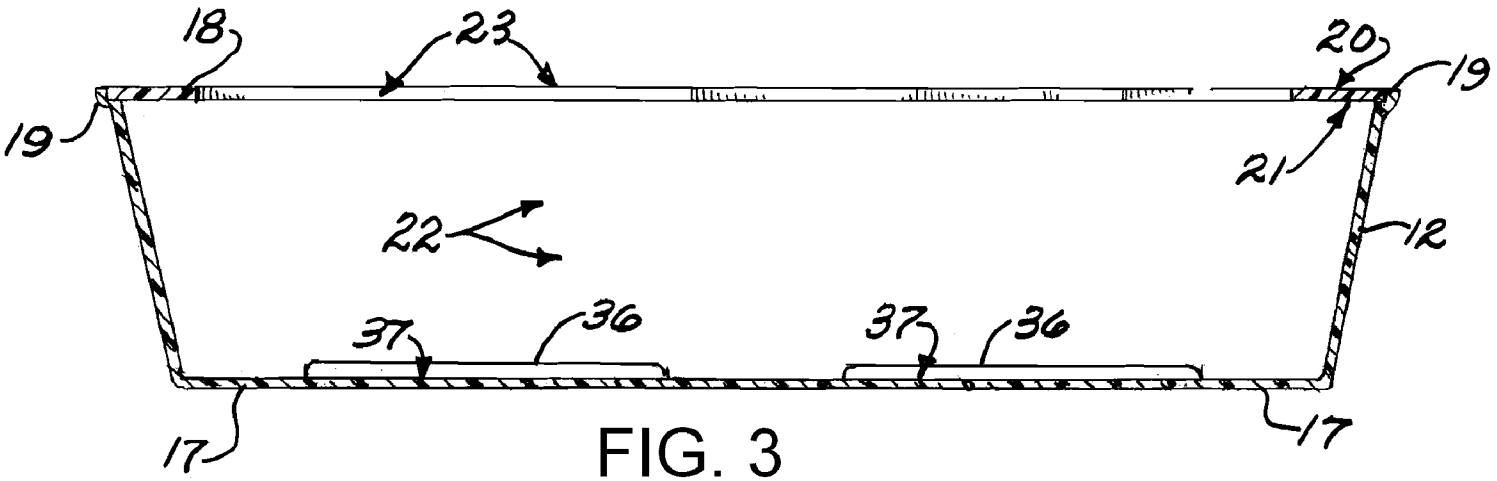
FIG. 3 is a sectional view of the preferred embodiment of the apparatus, taken along lines 3-3 of FIG. 1.
Figure 4:
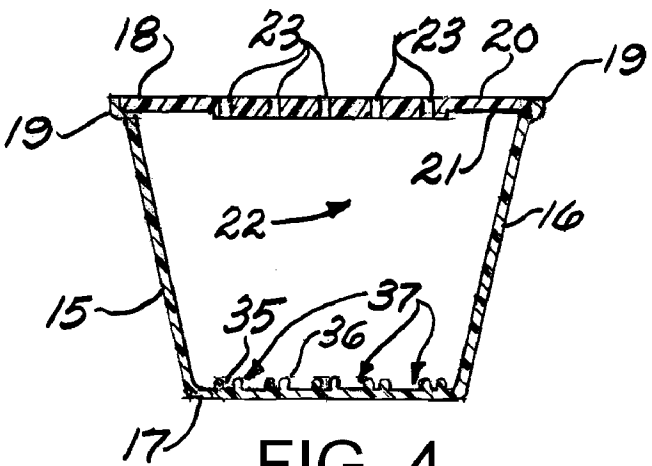
FIG. 4 is a sectional view of the preferred embodiment of the apparatus of the present invention taken along lines 4-4 of FIG. 1.
Figure 5:
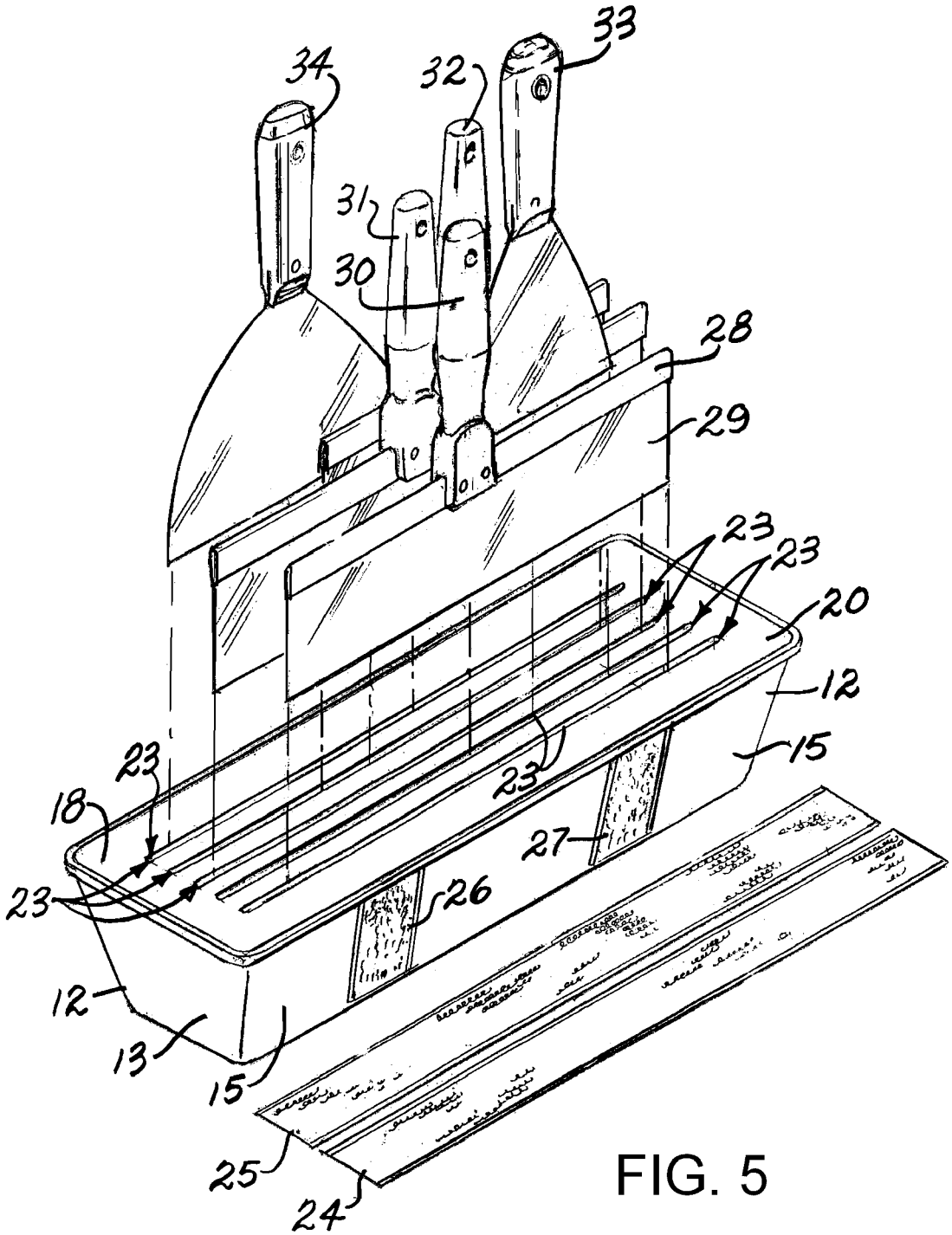
FIG. 5 is a perspective view of the preferred embodiment of the apparatus of the present invention.
Figure 7:
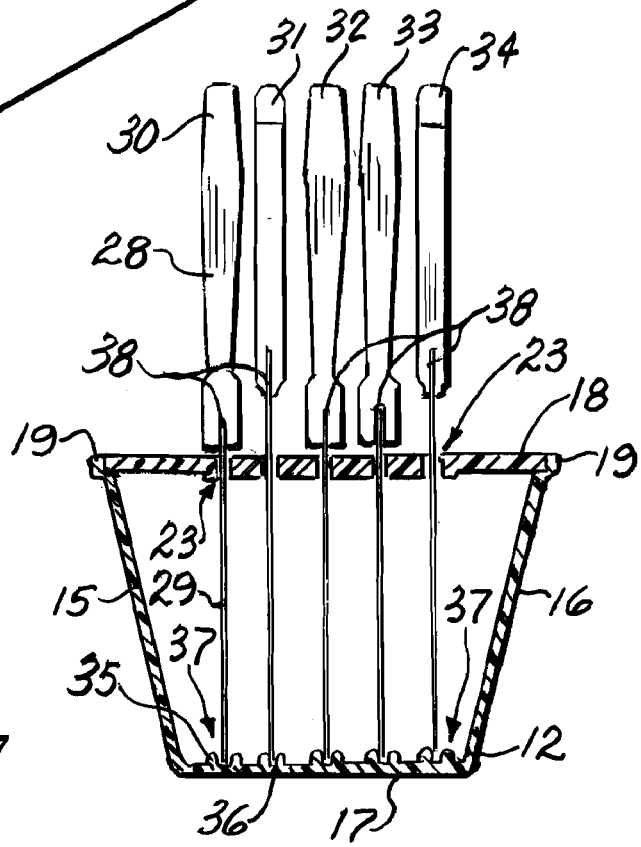
FIG. 7 is a sectional view of the preferred embodiment of the apparatus of the present invention.

A plurality of knives (commercially available and manufactured by e.g. Walpro/Stanley) can be stored in the slots 23 with the blades of the knives extending through the slots 23 until each blade rests upon the bottom 17. Each blade is secured in slots 37, as seen in FIGS. 5 and 7. The slots 37 are each defined by a pair of generally parallel, spaced apart ribs 35, 36 (see FIGS. 3, 4 and 7).

Each of the knives 31, 32, 33, 34 has a blade 29 and a handle 30. Some blades 29 are very wide and can extend almost the full length of the pan as shown in FIG. 5. When a plurality of the knives 31, 32, 33, 34 have been stored in panel 18 as shown in FIGS. 6 and 7, long straps 24, 25 are provided that are attached to the short straps on holder 12.

The straps 24, 25, 26, 27 can be in the form of strap members as shown, or straps that are attached to strap eyelets mounted on holder 12. The straps 24, 25, 26, 27 can provide hook and loop connectors. For example, the short straps 26, 27 can be provided with "hook" connectors while the long straps 24, 25 can be provided with "loop" connectors, such connecting straps 24, 25, 26, 27 being sold under the mark Velcro®.

Once the knives are in storage position as shown in FIGS. 5, 6 and 7, a strap 24 or 25 is placed across the plurality of blades of the knives at the rear 38 of each blade until the opposing short strap 26 or 27 is engaged and connected (e.g. Velcro®, hook and loop connection). The holder 12 with knives therein can then nest in pan 11.

PARTS LIST

The following is a list of suitable parts and materials for the various elements of the preferred embodiment of the present invention.

| PART NUMBER | DESCRIPTION |
|---|---|
| 10 | sheetrock knife and apparatus |
| 11 | pan |
| 12 | knife holder |

-continued

| PART NUMBER | DESCRIPTION |
|---|---|
| 13 | end wall |
| 14 | end wall |
| 15 | side wall |
| 16 | side wall |
| 17 | bottom wall |
| 18 | top panel |
| 19 | periphery |
| 20 | upper surface |
| 21 | lower surface |
| 22 | interior |
| 23 | slot |
| 24 | long strap |
| 25 | long strap |
| 26 | short strap |
| 27 | short strap |
| 28 | knife |
| 29 | knife blade |
| 30 | knife handle |
| 31 | knife |
| 32 | knife |
| 33 | knife |
| 34 | knife |
| 35 | rib |
| 36 | rib |
| 37 | slot |
| 38 | rear of blade |

The foregoing embodiments are presented by way of example only; the scope of the present invention is to be limited only by the following claims.

The invention claimed is:

1. A knife, pan and holder apparatus comprising:

a) a pan having a length, a width, a height, a bottom, sides and an open top, the sides each having an inside surface and an upper edge, said edges defining a pan periphery;

b) a blade holder that includes a panel that is attached to the pan near the open top, the panel having a peripheral edge that engages the pan near the periphery;

c) the panel including a plurality of slots that extend longitudinally across the panel, each slot being of a length that approaches the greater dimension of the length or width of the panel;

d) a plurality of knives that fit the panel at the slots, each knife having a blade with a length and a width, at least one knife having a blade width that is greater than the length of the blade, and at least one knife having a blade width that is much greater than the blade length; and e) knife holding straps that attach to the pan and blade holder combination and that extend transversely with respect to the slots.

2. The apparatus of claim 1 wherein the pan bottom has an area that is smaller than the area of the open top.

3. The apparatus of the claim 1 wherein the blade holder has a length and a width, the length being greater than the width and at least one of the slots has a length that approaches the length of the blade holder.

4. The apparatus of claim 1 wherein the blade holder has a length and a width, the length being greater than the width, and a plurality of the slots having a length that approaches the length of the blade holder.

5. The apparatus of claim 1 wherein each of the knives has a width that extends transversely at least one half the length or width of the pan.

6. The apparatus of claim 4 wherein the knives have a blade with a transverse width that extends transversely at least one half the length of the blade holder.

7. The apparatus of claim 1 wherein at least some of the sides are inclined.

8. The apparatus of claim 1 wherein all of the pan sides are inclined.

9. The apparatus of claim 1 wherein the blade holder rests upon the pan at the periphery and on the inside surfaces of the sides.

10. A knife, pan and holder apparatus comprising:

a) a pan having a length, a width, a height, a bottom, sides and an open top, the sides each having an inside surface and an upper edge, said edges defining a pan periphery;

b) a blade holder that includes a generally rectangular sheet that is supported by the pan next to the open top, wherein a plurality of the side panels of the pan are inclined;

c) the blade holder including a plurality of slots that extend longitudinally across the panel, each slot being of a length that approaches the greater dimension of the length or width of the panel;

d) a plurality of knives that fit the panel at the slots, each knife having a blade with a length and a width, at least one knife having a blade width that is greater than the length of the blade, and at least one knife having a blade width that is much greater than the blade length;

e) knife holding straps that attach to the pan and blade holder combination and that extend transversely with respect to the slots; and f) a plurality of parallel grooves in the pan bottom that are receptive of the blades.

11. The apparatus of claim 10 wherein the pan bottom has an area that is smaller than the area of the open top.

12. The apparatus of the claim 10 wherein the blade holder has a length and a width, the length being greater than the width and at least one of the slots has a length that approaches the length of the blade holder.

13. The apparatus of claim 10 wherein the blade holder has a length and a width, the length being greater than the width, and a plurality of the slots having a length that approaches the length of the blade holder.

14. The apparatus of claim 10 wherein each of the knives has a width that extends transversely at least one half the length or width of the pan.

15. The apparatus of claim 10 wherein the knives have a blade with a transverse width that extends transversely at least one half the length of the blade holder.

16. The apparatus of claim 10 wherein at least some of the sides are inclined.

17. The apparatus of claim 10 wherein all of the pan sides are inclined.

18. The apparatus of claim 10 wherein the blade holder rests upon the pan at the periphery and on the inside surfaces of the sides.

19. The apparatus of claim 10 further comprising grooves on the pan bottom panel for receiving a blade edge.

* * * * *